US007699715B2

(12) United States Patent
McFarlin et al.

(10) Patent No.: US 7,699,715 B2
(45) **Date of Patent: *Apr. 20, 2010**

(54) PORTABLE GOLF PRACTICE DEVICE

(75) Inventors: James A. McFarlin, Los Angeles, CA (US); Margaret Tsuey-Hwa McFarlin, Los Angeles, CA (US)

(73) Assignee: FairwayPro, LLC, Los Angeles, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/846,522

(22) Filed: Aug. 28, 2007

(65) Prior Publication Data

US 2007/0293338 A1 Dec. 20, 2007

Related U.S. Application Data

(63) Continuation-in-part of application No. PCT/US2005/047022, filed on Dec. 27, 2005.

(51) Int. Cl.
*A63B 69/36* (2006.01)

(52) U.S. Cl. ..... 473/278; 473/279

(58) Field of Classification Search ..... 473/150, 473/157, 218, 257–266, 278, 279
See application file for complete search history.

(56) References Cited

U.S. PATENT DOCUMENTS

| | | | | |
|---|---|---|---|---|
| 4,130,283 | A * | 12/1978 | Lindquist | 473/262 |
| 4,779,796 | A * | 10/1988 | Lai | 473/279 |
| 4,875,685 | A * | 10/1989 | Ballinger et al. | 473/262 |
| 6,994,634 | B1 * | 2/2006 | McFarlin et al. | 473/278 |
| 7,384,346 | B2 * | 6/2008 | McFarlin et al. | 473/278 |
| 2007/0155526 | A1 * | 7/2007 | McFarlin et al. | 473/278 |
| 2007/0293338 | A1 * | 12/2007 | McFarlin et al. | 473/278 |

* cited by examiner

*Primary Examiner*—Nini Legesse
(74) *Attorney, Agent, or Firm*—Lawrence S. Cohen

(57) ABSTRACT

A portable golf practice device is disclosed that is easily transported by the golfer and simulates the response of natural turf when impacted by the club head during a golf swing. The device includes a simulated turf surface fitted in a carriage tray. The carriage tray is supported on a retraction assembly on which it can slide forward and back, and which has springs that will retract it after it has moved forward. The retraction assembly is supported on a base member. In use, when the turf surface is hit by a golf club it moves forward simulating the feel of actual turf, and then returns to its ready to use position.

21 Claims, 12 Drawing Sheets

PORTABLE GOLF PRACTICE DEVICE

RELATED APPLICATIONS AND PATENTS

This application is a continuation-in-part of PCT application serial number PCT/US2005/047022 having an international filing date of Dec. 27, 2005 and claiming a priority date of Mar. 1, 2005 from U.S. patent application Ser. No. 11/070,320 filed on Mar. 1, 2005 the priority of which is claimed for this application for the common subject matter, and the content of all of which is incorporated herein by reference

TECHNICAL FIELD

The present invention relates in general to a golf practice device, and more particularly to a golf practice device that (1) is practically portable and can easily be transported by the golfer to any indoor/outdoor golf practice facility, and (2) has a surface component that yields and moves when impacted by the head of a golf club to simulate the response of natural turf and facilitate the practice and development of a correct golf swing.

BACKGROUND ART

To be skilled at the techniques of golf requires a golfer to practice regularly beyond the time spent on playing the game on golf courses. Many indoor/outdoor golf practice facilities have been created to accommodate golfers' need to practice, and the use of golf practice mats at these facilities is a common and long-established practice. The conventional golf practice mats are available in a variety of materials and have a surface layer simulating natural grass. These mats generally perform adequately for practicing wood shots off a tee. However, they are deficient for practicing iron shots and may actually impede the development of a correct swing.

A correct iron shot requires the golf club head to impact the golf ball on the downswing momentarily before it reaches the lowest point of the swing arc, i.e., the path of the golf club head during a swing. The descending club head will naturally remove a small patch of turf, known as a divot, below or immediately in front of the ball. Conventional golf practice mats are generally of stiff, unyielding construction and do not allow the action of taking a divot. A correct golf swing practiced on such a mat will actually produce the wrong "feel" as the club head, after hitting the ball, is impeded by and bounces off the mat. Further, to lessen the shock to the wrists and elbows and risk of injury, the golfer may alter his swing to "scoop" or sweep the ball off the mat cleanly instead of hitting "down and through" and thus develop an incorrect way of hitting iron shots. Also, when the golfer makes an incorrect swing and strikes the mat behind the ball, i.e., making a "fat" shot, the shock from hitting a hard and unyielding surface can lead to injuries to elbows and other joints. Lastly, some golf practice mats have a surface layer consisting of long fibers or inverted brushes to help reduce club head bounce and risk of injury. However, these mats may have too much "give" and more closely simulate fringe grass than fairway turf.

Many golf practice devices have been conceived over the years in an attempt to simulate the feel of hitting natural turf, some are designed to be portable so golfers can carry and use them at golf practice facilities. Examples are shown in the following U.S. patents.

U.S. Pat. No. 6,156,396 issued to Florian discloses a device consists of a base pad formed of a resilient elastomeric material and an artificial grass carpet positioned on the base pad.

When a golf ball on the carpet surface is struck, the carpet slides a limited distance and is then returned by an elastic biasing mechanism.

U.S. Pat. No. 5,888,147 issued to Luedtke discloses a device comprises an anchor piece and a divot piece connected by elastic rubber bands.

U.S. Pat. No. 5,692,967 issued to Guyer discloses a device consists of a support frame, a mat and a tray with a set of casters that roll on descending ramps attached to the frame. When a golf ball is hit from the mat, the mat and tray deflect downwardly, the mat slides partially off the tray and the tray rolls down the ramps. The mat and tray return to the original position via a tension spring means.

U.S. Pat. No. 4,932,663 issued to Makar discloses a device comprises an artificial turf mat suspended under tension within a rigid frame. The mat is displaced downward upon impact with a golf club. Multiple surface layers can be employed to simulate golf shots from the fairway, rough and sand trap.

U.S. Pat. No. 4,875,685 issued to Ballinger, et al. discloses an apparatus that includes a platform for the golfer to stand on, a main frame connected to the platform adjacent thereto, and an inner frame covered with artificial turf surface and mounted within the main frame. The inner frame pivots forward and then downward in a generally arcuate path when the surface is impacted by the golf club head. The platform can be folded to form a carrying case in which the components can be stored.

U.S. Pat. No. 4,130,283 issued to Lindquist discloses a device with artificial turf secured to a cushioned support that is movable in the direction of the ball flight and compressible when the surface is struck. The movable and compressible portion returns via a spring means.

U.S. Pat. No. 3,712,628 issued to Boss, Jr. discloses a device comprises a rigid housing containing rollers which support an endless belt with simulated grass outer surface. A platform beneath the upper portion of the belt pivots about one end and is held against the inner surface of the belt by an elastic means.

While these devices may accomplish their stated objectives to some extent, they either (1) are too complex or too expensive to manufacture to be economically viable; or (2) are too heavy or bulky to be practically transportable; or (3) have a height dimension that requires the golfer to stand on an elevated platform; or (4) require extraneous means for the device to be anchored to the ground, which is impractical when the ground is hard surface such as concrete.

There exists a need for a golf practice device that is portable so the golfer can easily transport it to a golf practice facility and, when struck by a golf club head during a golf swing, yields and moves in such a manner as to simulate the response of natural turf.

DISCLOSURE OF INVENTION

The present invention relates to a golf practice device that is portable, yields and moves when impacted by the head of a golf club, and more accurately simulates what the golfer experiences when hitting a golf ball off natural turf.

One aspect of the present invention provides a golf practice device that is relatively compact so it can easily be carried and transported, and does not require any means for it to be anchored or affixed to the ground or other objects. The device includes a base member and a base extension. In use, the device is placed adjacent to a practice platform, which is generally any one of the commercially available golf practice mats typically available at golf practice facilities. The base extension is unfolded and slid under the practice platform. The combined weight of the practice platform and the golfer on the base extension keeps the device stationary during use.

Another aspect of the present invention provides a golf practice device which has a surface component that yields and moves when impacted by the head of a golf club to simulate the response of natural turf. The device includes a base member having a top surface that slopes downward from the aft end to the forward end and a plurality of grooves therein. A roller assembly comprising rods and sleeve bearings is placed on the base member and fits in said network of grooves. The sleeve bearings preferably are made of anti-friction, self-lubricating material and produce minimal friction and noise during operation. A tray rests on top of the roller assembly with a simulated turf layer fitted therein. When a golf ball placed on the simulated turf layer is struck by a golf club, the force imparted to the device sends the tray together with the simulated turf layer sliding forward down a descending slope, thus simulating the feel of hitting natural turf. Means are provided to control the sliding forward and the retraction to their original position of the tray and the simulated turf layer.

Yet another aspect of the present invention provides a golf practice device that reduces club head bounce and lessens stress on the golfer's wrists and elbows, thus reducing negative reinforcement experienced by the golfer and increasing his confidence, which is critical to the development of a correct and reliable golf swing.

These and other aspects of the present invention will become apparent after a reading of the following description and accompanying drawings.

BRIEF DESCRIPTION OF DRAWINGS

It is to be understood that like elements are identified throughout the drawings with like reference numerals.

BEST MODE FOR CARRYING OUT THE INVENTION

Figure 1:
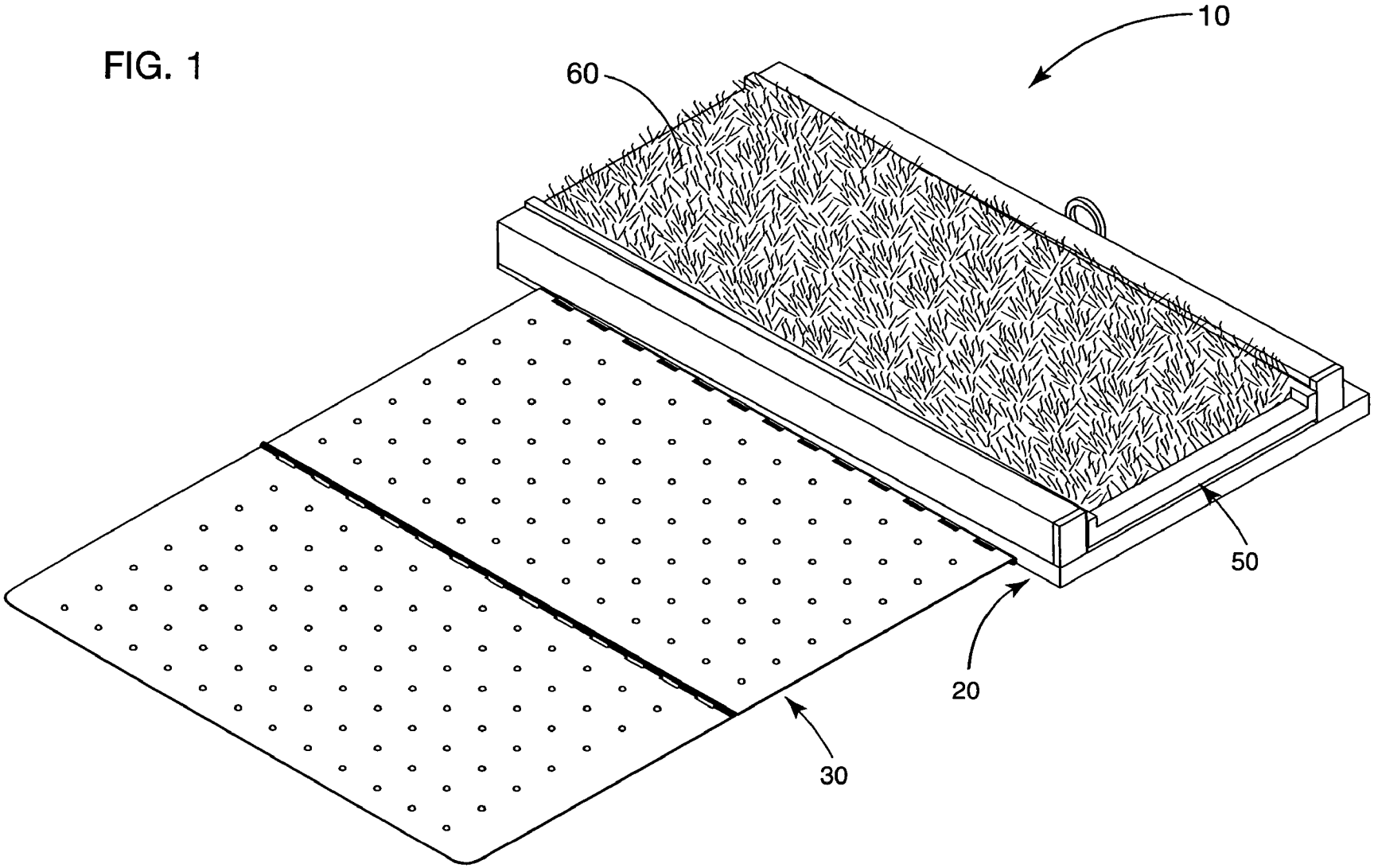
FIG. 1 is a perspective view of the preferred embodiment of the portable golf practice device constructed in accordance with the present invention.
Figure 2A:
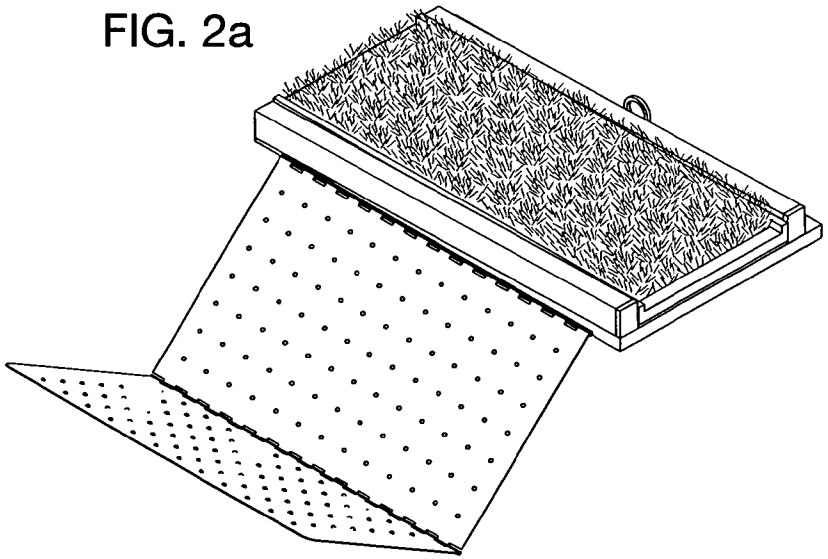
FIGS. 2*a*-2*d* are a series of perspective views of the portable golf practice device shown in FIG. 1 showing the base extension through the process of being folded into a transport/storage configuration.
Figure 2B:
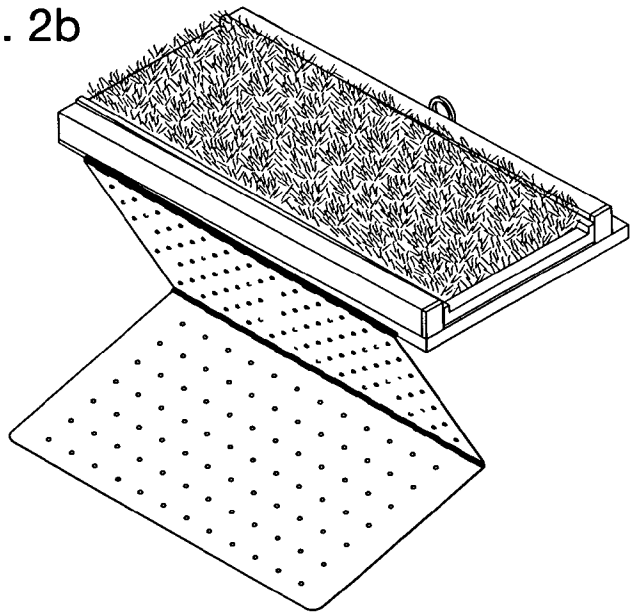
Figure 2C:
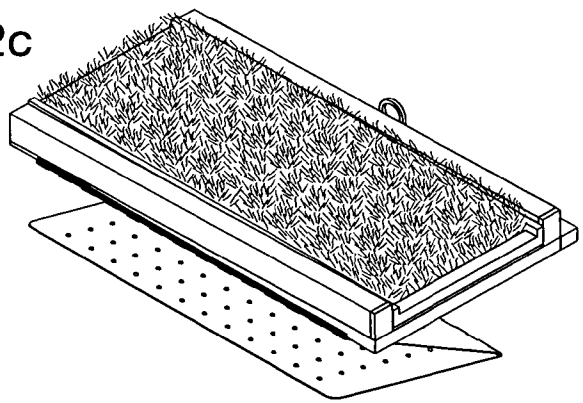
Figure 2D:
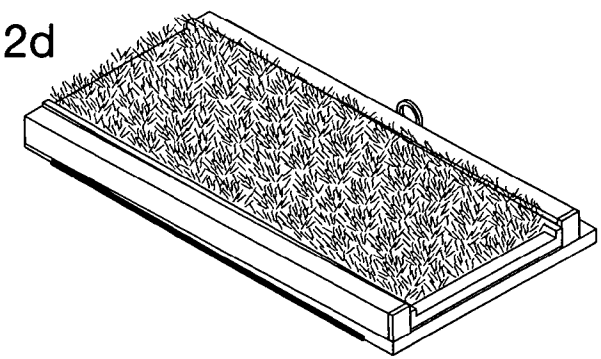
Figure 3:
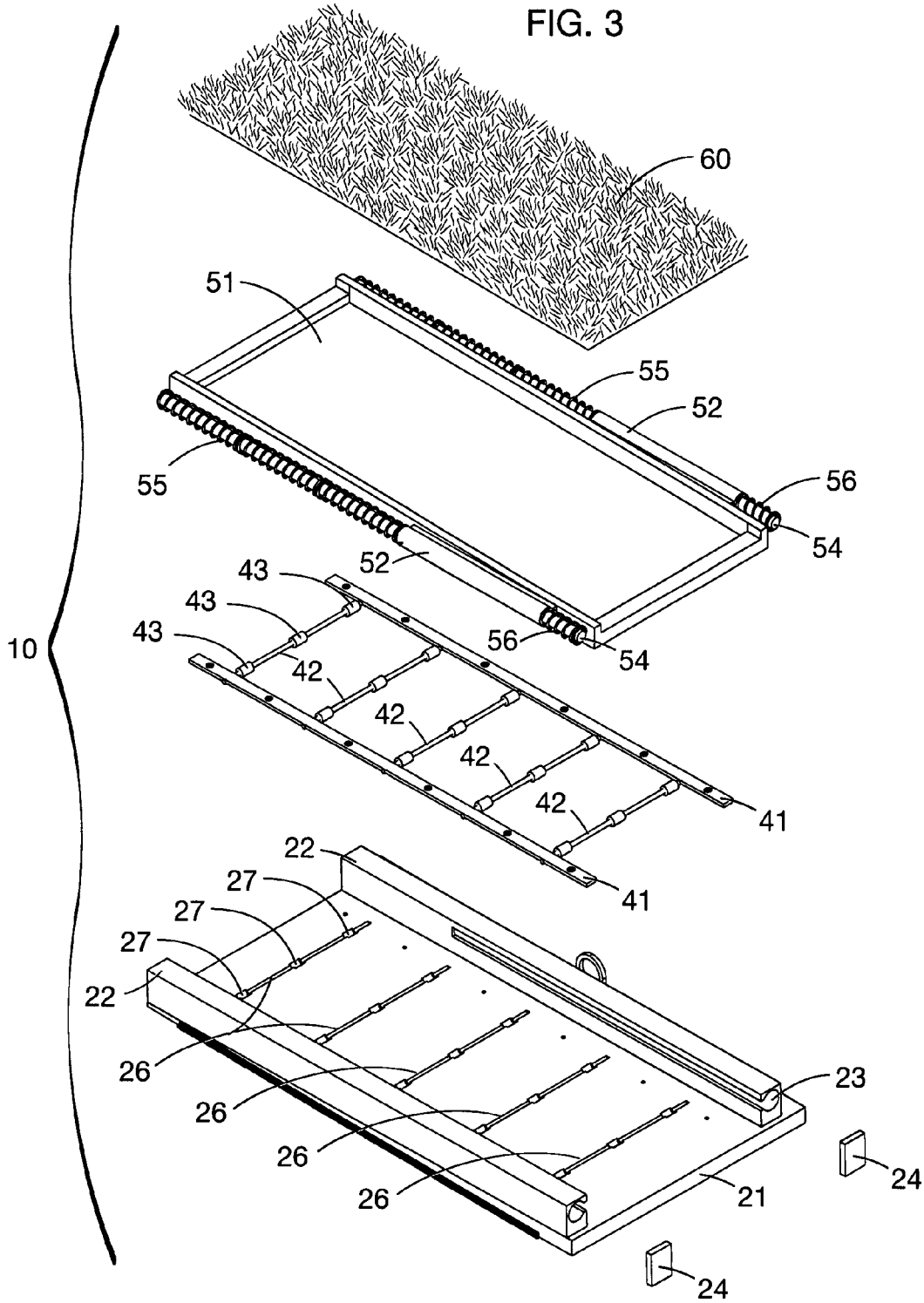
FIG. 3 is an exploded perspective view of the portable golf practice device shown in FIG. 1 illustrating the various layers comprising the device, with the base extension in a storage configuration.

The portable golf practice device according to the concepts of the present invention and how it functions can best be explained by reference to the attached drawings. As illustrated in FIGS. 1 and 3, the preferred embodiment of the portable golf practice device 10 comprises a base member 20, a base extension 30, a roller assembly 40, a carriage assembly 50 and a simulated turf surface 60.

Figure 4:
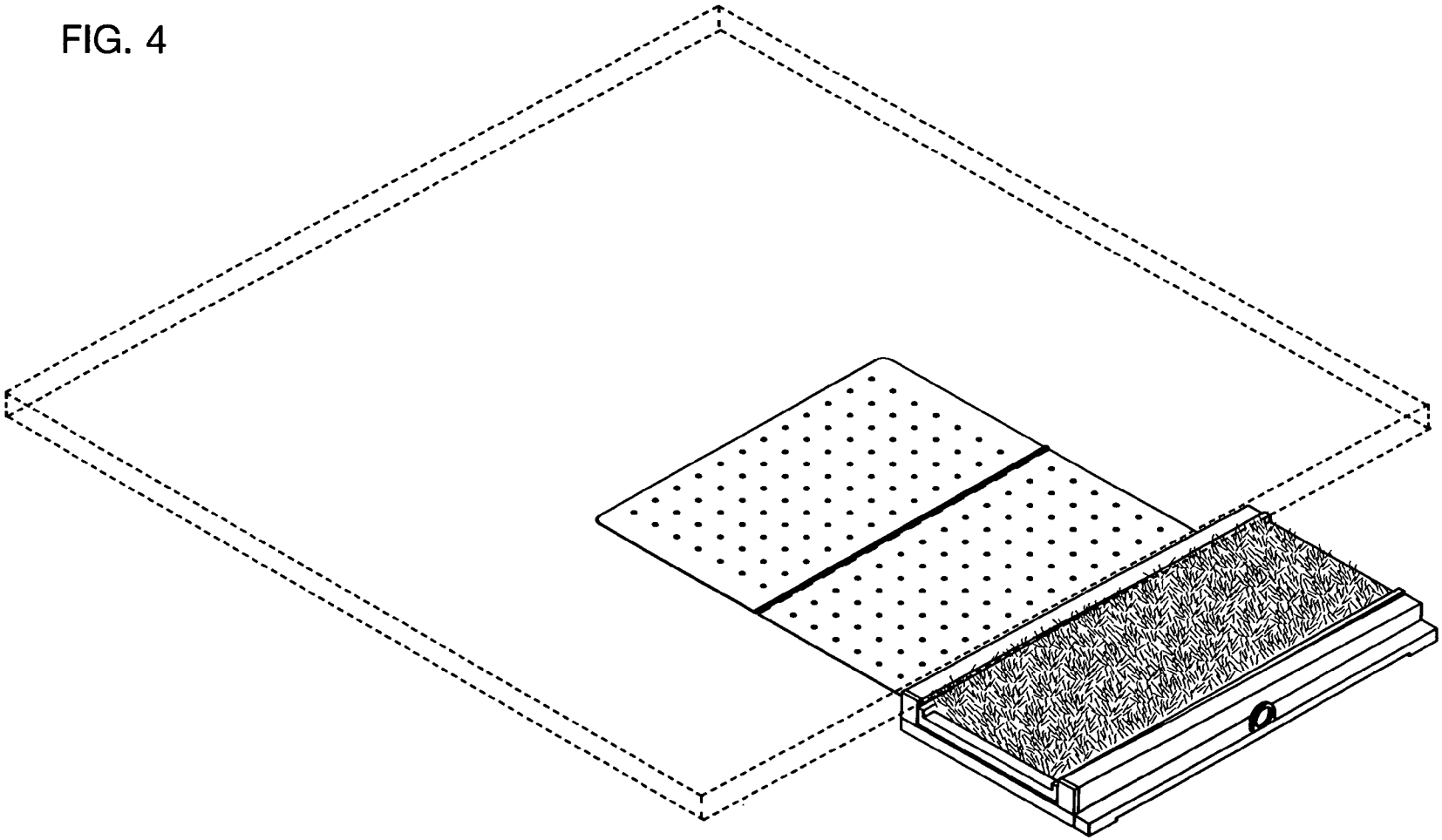
FIG. 4 is a perspective view of the portable golf practice device shown in FIG. 1 disposed adjacent to a platform, drawn in dotted lines, for supporting a golfer.
Figure 6:
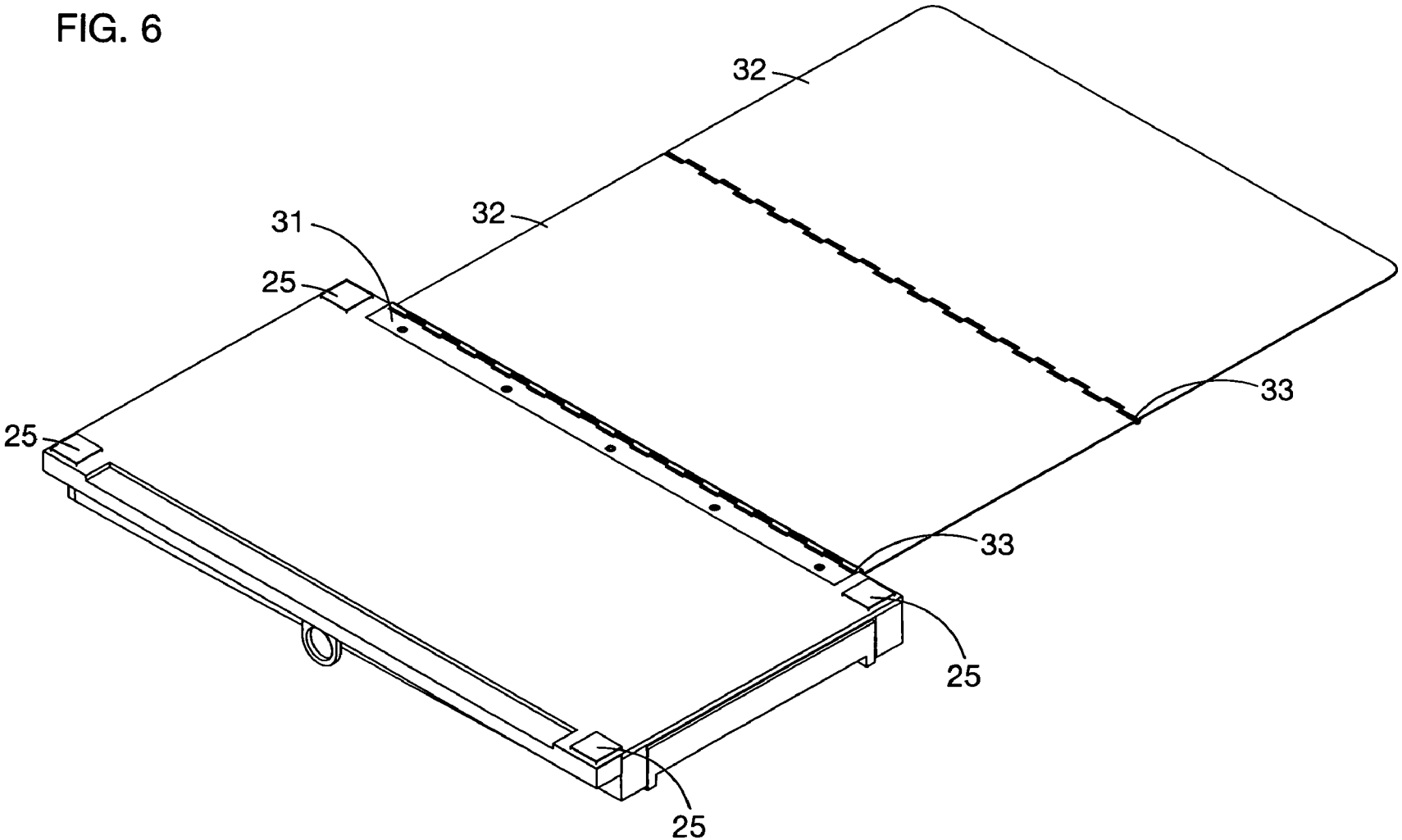
FIG. 6 is a bottom perspective view of the portable golf practice device shown in FIG. 1.
Figure 7:
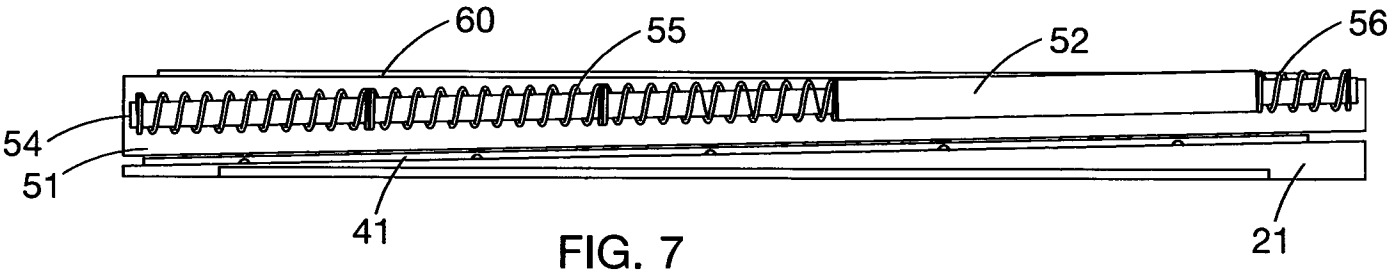
FIG. 7 is a longitudinal, side elevational view of the portable golf practice device shown in FIG. 1 with the carriage assembly and simulated turf surface in the at-rest position and the enclosed rail housing omitted to show the carriage retraction means.
Figure 8:
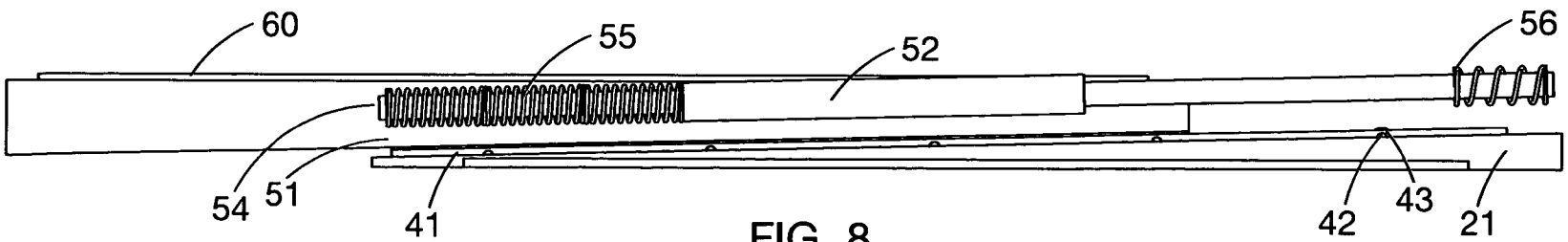
FIG. 8 is a longitudinal, side elevational view of the portable golf practice device similar to FIG. 7 with the carriage assembly and simulated turf surface in an extended position and the enclosed rail housing omitted to show the carriage retraction means.
Figure 9:
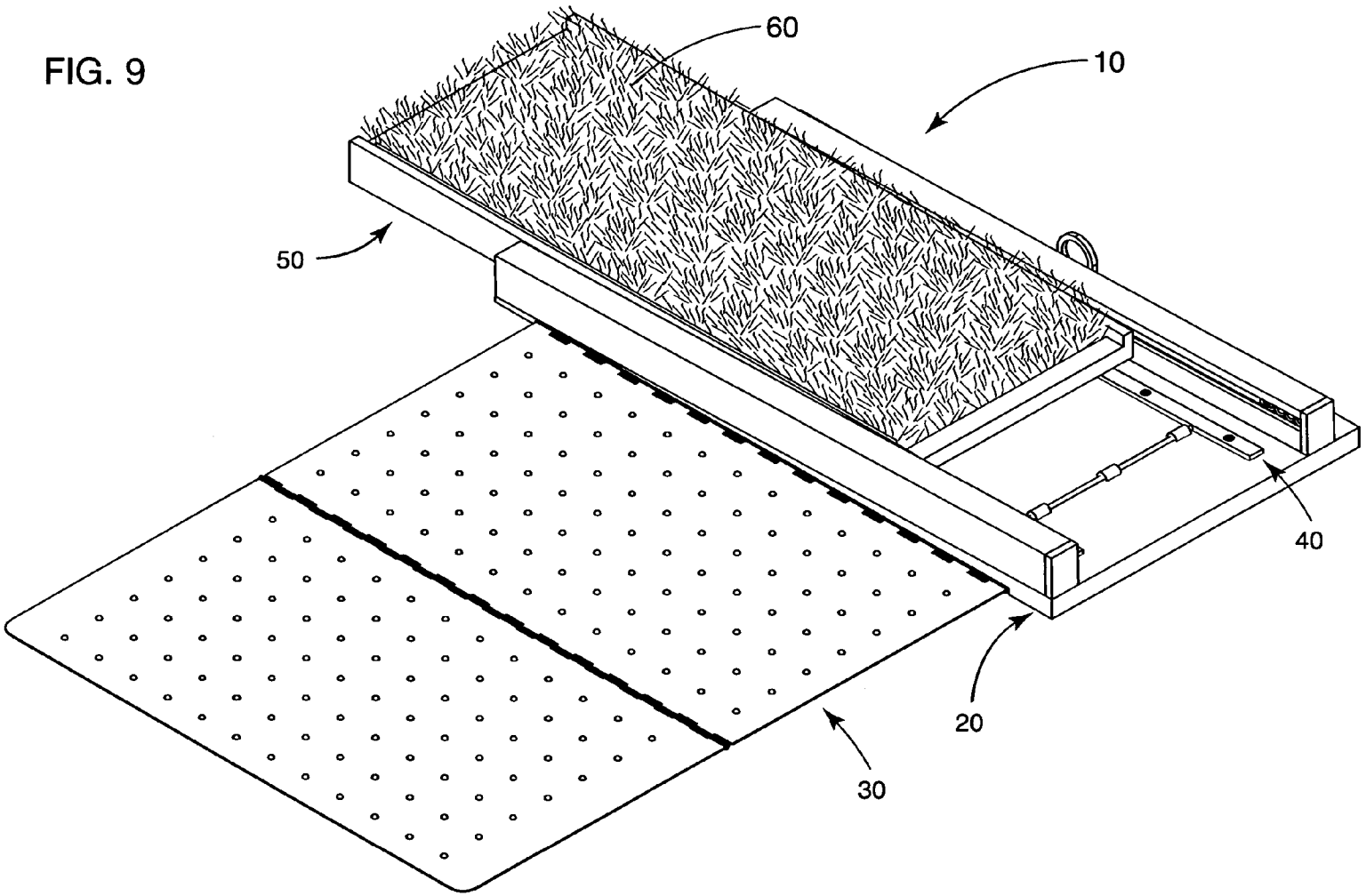
FIG. 9 is a perspective view of the portable golf practice device shown in FIG. 1 with the carriage assembly and simulated turf surface in an extended position.

Referring now to FIGS. 3 and 4, the base member 20 consists of a bottom panel 21 that is generally rectangular in shape with its longitudinal axis generally aligned with the path of the head of a golf club during a golf swing, and a pair of parallel enclosed rail housings 22 positioned along the length dimension of the bottom panel 21 on either side to form a U-shaped frame. The top surface of the bottom panel 21 slopes slightly downward from the aft end to the forward end. The cross section, as can be understood from FIGS. 7 and 8, is a trapezoid with the vertical sides being the bases. There is a ledge along the length dimension of the bottom panel 21 on the side opposite the base extension 30 for a handle means to be installed such that the device may be lifted easily out of a carrying case or off the ground. The enclosed rail housings 22 have cylindrical cavities for receiving the carriage retraction means 53, which are part of the carriage assembly 50 that is detailed below with reference to FIGS. 3 and 5. The sides of the enclosed rail housings 22 facing the interior of the U-shaped frame have slots 23 to allow the carriage tray 51 to slide forward and retract. The cylindrical cavities and the slots 23 all slope slightly downward from the aft end to the forward end at the same angle as the top surface of the bottom panel 21. As illustrated in FIG. 3, the enclosed rail housings 22 have end caps 24 on the aft end that are fabricated separately. After the carriage assembly 50 has been installed with the carriage retraction means 53 fitted inside the enclosed rail housings 22, the end caps 24 are then affixed to the ends of the enclosed rail housings 22, the guide rails 54 and the bottom panel 21 through any conventional means suitable for the material used to fabricate the base member 20 and is generally well known in the art. The base member 20 is supported, as illustrated in FIG. 6, by support feet 25 fitted in recessed areas in the undersurface of the bottom panel 21 and preferably formed of a resilient material such as rubber. Alternatively, a cushioning layer made of a resilient material is affixed to the undersurface of the bottom panel 21 instead of employing support feet 25. The base member 20 is preferably made of thermoplastic but can be fabricated with generally any structural material such as metals, metal alloys or plastics, and can be either a single-piece construction or assembled from parts.

In the top surface of the bottom panel 21 is plurality of transverse grooves 26 which further include a plurality of half-cylinder-shaped recesses 27. This pattern of indentations is to receive the roller assembly 40 that is detailed below with reference to FIG. 3.

As illustrated in FIGS. 1, 2, 6 and 9, the base extension 30 consists of a foot plate 31 and one or multiple extension plates 32 connected by hinge means 33. The extension plates 32 have generally the same width dimension but shorter length dimension as the bottom panel 21, and the foot plate 31 has the same length dimension but shorter width dimension as the extension plates 32. The hinge means allow the foot plate 31 and extension plates 32 to be folded and stacked one on top of another into a transport/storage configuration, as illustrated in FIGS. 2*a*-2*d*. The underside of the bottom panel 21 has two recessed areas on either side along the length dimension generally of the same dimensions as the foot plate 31. The foot plate 31 is fitted in one of the recessed areas and secured to the base member 20 by any conventional means that allows disassembly and reassembly by the golfer. As illustrated in FIG. 6, screws are used to fasten the base extension 30 to the base member 20, though any other suitable material and means may be used for this purpose. FIG. 1 illustrates a base member 20 and base extension 30 configuration suitable for a right-handed golfer; however, the base extension 30 can be disconnected, moved to the opposite side and reconnected for use by a left-handed golfer.

The base extension 30 is designed for the purpose of providing stability when the portable golf practice device 10 is in use. As illustrated in FIG. 4, the base extension 30 is to be unfolded and slid under a practice platform thereon the golfer stands. The practice platform may be any one of the commercially available golf practice mats used at golf practice facilities, or any suitable piece of material that provides adequate cushion and has a non-skid surface that allows the golfer to maintain his footing through a golf swing. The combined weight of the practice platform and the golfer on the base extension 30 keeps the portable golf practice device 10 stationary during use. Furthermore, the top surface of the extension plates 32 preferably has a plurality of protrusions or studs that create friction between the practice platform and the base extension 30 and further prevent slippage during use.

As illustrated in FIG. 3, the roller assembly 40 comprises a pair of longitudinal bars 41, a plurality of transverse rods 42 and a plurality of sleeve bearings 43 fitted over the transverse rods 42. The number, placement and dimensions of the transverse rods 42 and sleeve bearings 43 correspond to the number, placement and dimensions of the transverse grooves 26 and recesses 27 in the top surface of the bottom panel 21, respectively. The longitudinal bars 41 are affixed to the base member 20 to hold the roller assembly 40 in place, with the transverse rods 42 and sleeve bearings 43 engaged in the transverse grooves 26 and recesses 27, respectively. FIG. 3 illustrates the use of screws as the affixation means; however, other suitable, conventional means may be employed. The sleeve bearings 43 preferably are made of polymers reinforced by fibers and filled with internal anti-friction lubricants so as to minimize friction and noise and reduce wear on the counter surfaces during operation.

Figure 5:
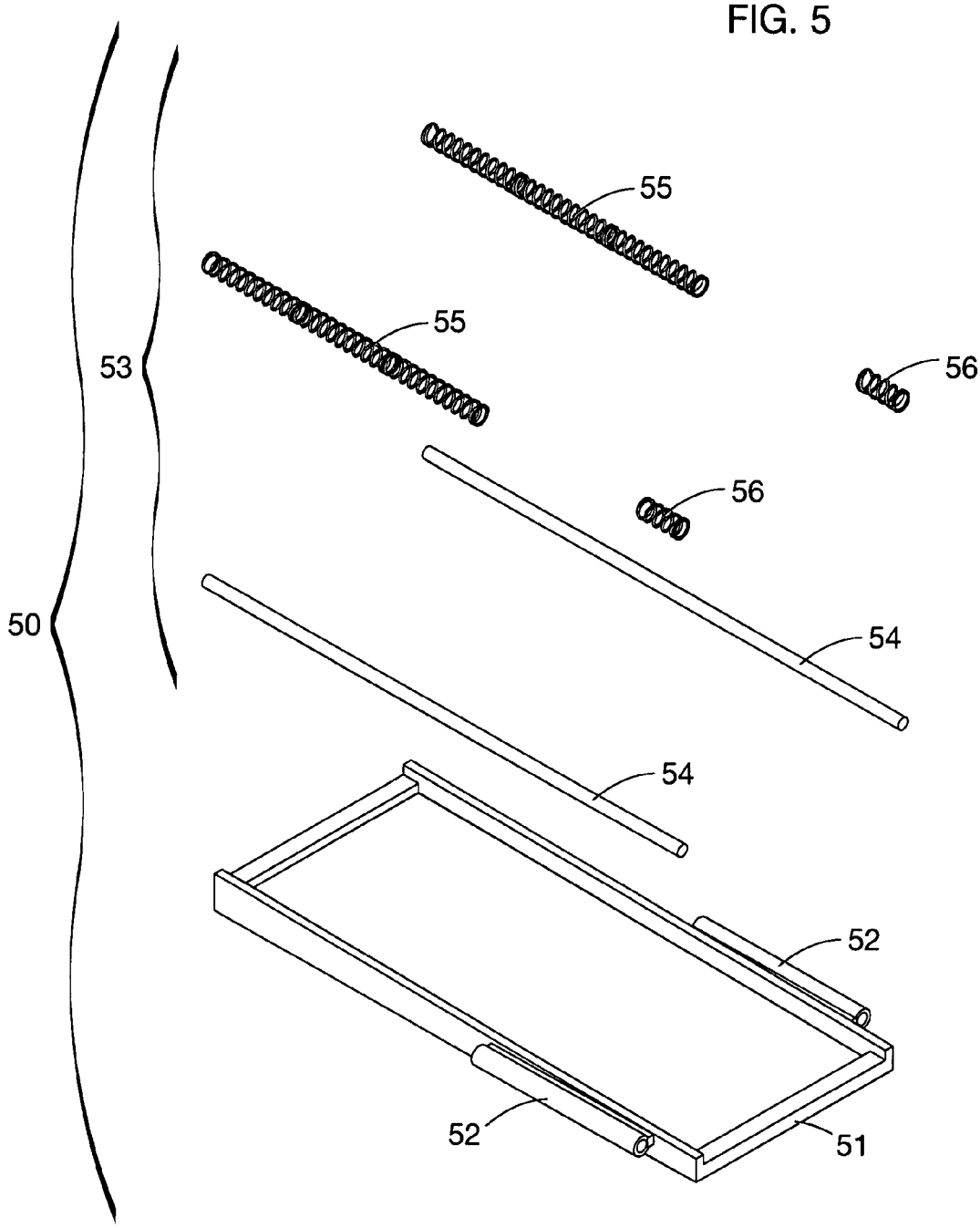
FIG. 5 is an exploded perspective view of the carriage assembly of the portable golf practice device shown in FIG. 1.

As illustrated in FIGS. 3 and 5, the carriage assembly 50 comprises a generally rectangular carriage tray 51 with sleeves 52 and dual carriage retraction means 53. Each carriage retraction means 53 further consists of a guide rail 54, one or multiple forward compression springs 55 and a rearward compression spring 56, with the compression springs 55, 56 generally having the same inner and outer diameters as the sleeves 52. The sleeves 52 are hollow cylindrical tubes that are affixed to the sides of the carriage tray 51 and positioned toward the aft end. When assembled, the sleeves 52 are fitted over the guide rails 54 and sandwiched between the forward and rearward compression springs 55, 56 such that the movement of the carriage tray 51 is controlled by the carriage retraction means 53. The top surface of the carriage tray 51 is level and has upstanding edges on all sides. Preferably, the edge on the forward side is lower than the other three. The bottom surface of the carriage tray 51 slopes from the aft end to the forward end at the same angle as the top surface of the bottom panel 21; i.e., the two plane surfaces are parallel to each other. The sleeves 52 and the carriage retraction means 53 also slope at the same angle as the bottom surface of the carriage tray 51. When assembled, the carriage assembly 50 sits on the roller assembly 40 when at rest and slides forward and back over the roller assembly 40 when in motion. The carriage assembly 50 is preferably made of thermoplastic and can be either a one-piece construction or assembled from parts.

As illustrated in FIGS. 1-3 and 9, the simulated turf surface 60, which may be any one of the commercially available artificial turfs that are made of sturdy plastic and used for golf practice mats, generally fits the dimensions of the carriage tray 51. The simulated turf surface 60 may be adhesively bonded to the carriage tray 51 or, preferably, removably affixed to the carriage tray 51 with attaching means such as hook-and-loop fasteners.

An alternate embodiment of the invention utilizes the same components and means with only several modifications as described below. Typically, plastic-to-plastic moving-part applications create much more friction and wear than plastic-to-metal applications. Roller assembly 40 is employed in the preferred embodiment for the purpose of reducing friction, wear and noise. In the alternate embodiment, the carriage tray 51 and the bottom panel 21, and optionally the sleeves 52 and enclosed rail housings 22, are fabricated with filled and alloyed plastic composites possessing performance qualities such as: improved abrasion-resistance, lower static and dynamic friction, higher compressive strengths and improved creep resistance. When both the carriage tray 51 and the bottom panel 21 are fabricated with such plastic composites, they are to be made of dissimilar polymers to ensure low coefficient of friction. The carriage tray 51 thus can sit directly on the bottom panel 21, eliminating the requirements of the roller assembly 40 and the corresponding transverse grooves 26 and recesses 27 in the bottom panel 21.

A second alternate embodiment of the invention also eliminates the requirements of the roller assembly 40 and the corresponding transverse grooves 26 and recesses 27 in the bottom panel 21. Instead, an anti-friction layer made of a low-friction material such as Teflon® is applied to the surface of the bottom panel 21 to reduce friction, wear and noise.

Figure 12:
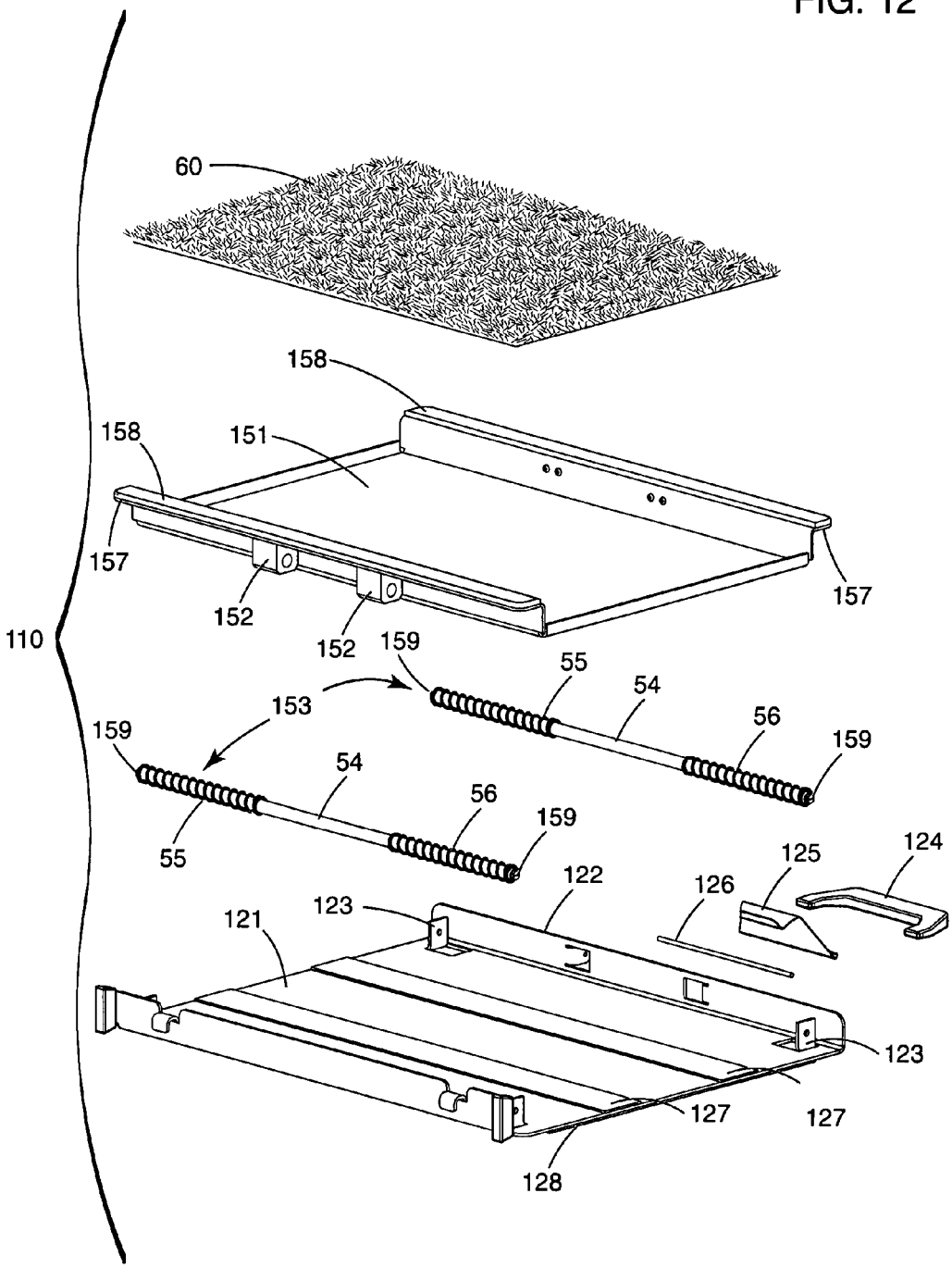
FIG. 12 is an exploded perspective view of the portable golf practice device shown in FIG. 10 with the base extension omitted from the illustration.

The following describes another alternate embodiment 110 of the invention and can best be explained by reference to FIGS. 10-13. The golf practice device comprises a base member 120, and a carriage assembly 150 comprising a carriage tray 151 and carriage retraction assemblies 153. The base member 120 has a bottom panel 121 and side frames 122 extending along the length dimension and support members 123 extending upwardly from the bottom panel 121. The carriage assembly 150 comprises a carriage tray 151 with flanges 157 along the longitudinal sides, at least one sleeve 152 attached to the carriage tray 151. In the embodiment shown there are two sleeves 152 on each side, spaced apart. There is a carriage retraction assembly 153 on each longitudinal side, which as will be seen below and from the figures is mounted on the carriage tray 151 and attached to the base member 120. A simulated turf surface 60 is affixed to the carriage tray 151. Preferably, bumpers 158 made of a resilient material are affixed to the top of the flanges 157 to protect the device 110 in case of a miss-hit. A carriage retraction assembly 153 is arranged on each longitudinal side of the carriage tray 151 and each carriage retraction assembly 153 further consists of a guide rail 54, one or multiple forward compression springs 55 and one or multiple rearward compression springs 56. As seen in FIG. 12 there are on each side a pair of longitudinally spaced apart sleeves 152 on the carriage tray 151.

Figure 10:
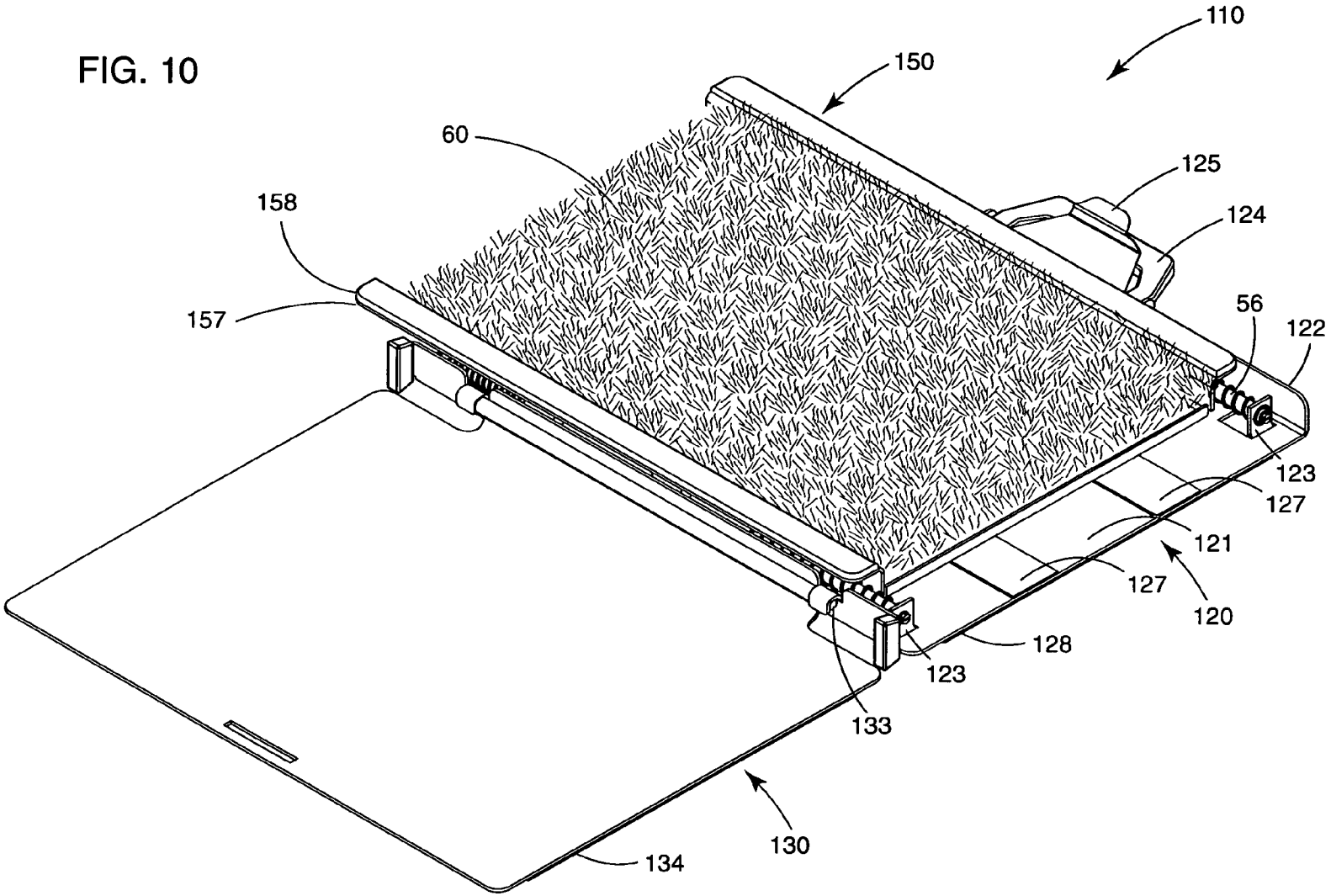
FIG. 10 is a perspective view of an alternate embodiment of the portable golf practice device constructed in accordance with the present invention.
Figure 11:
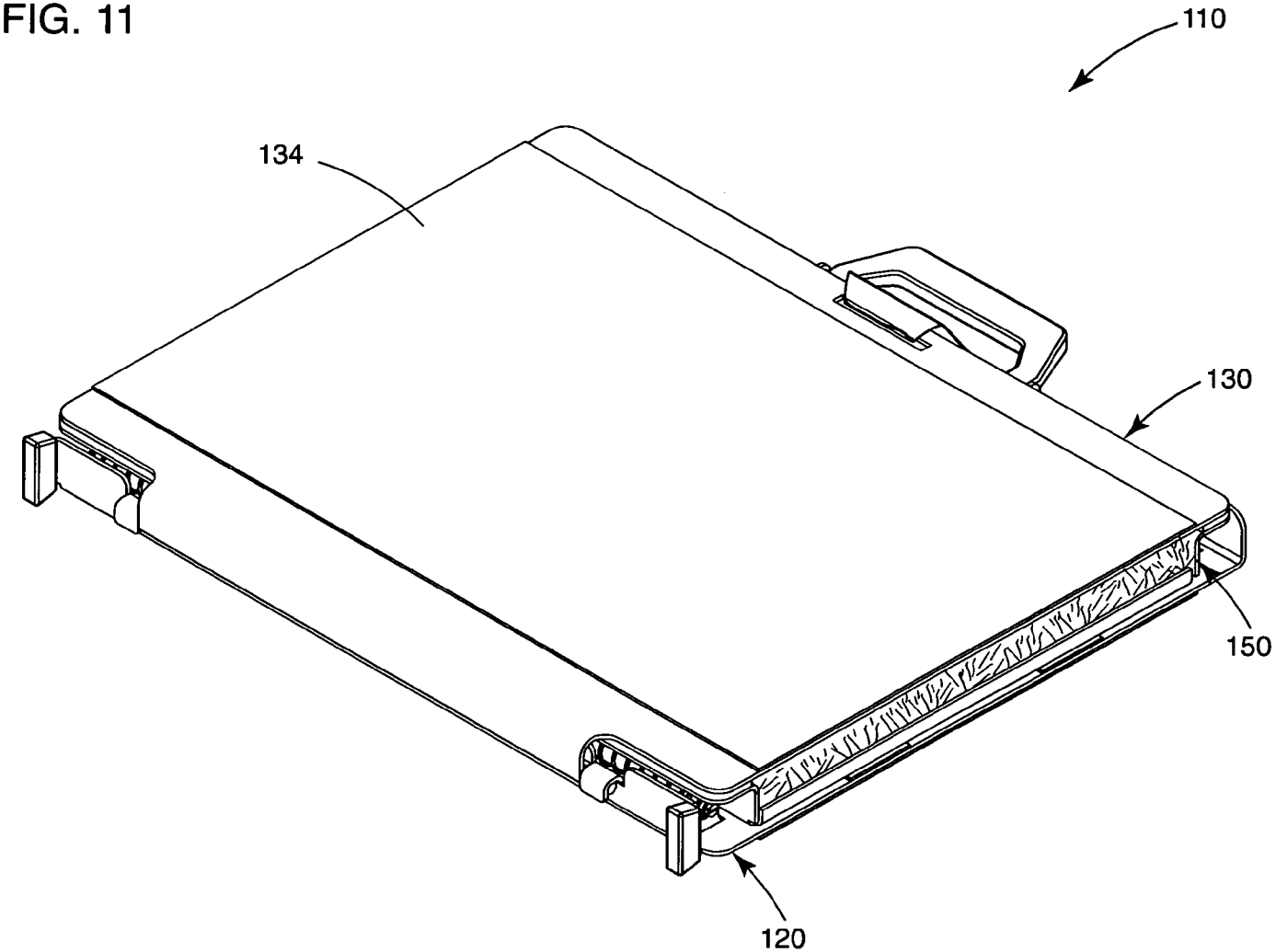
FIG. 11 is a perspective view of the portable golf practice device shown in FIG. 10 with the base extension in a storage or travel configuration.
Figure 13:
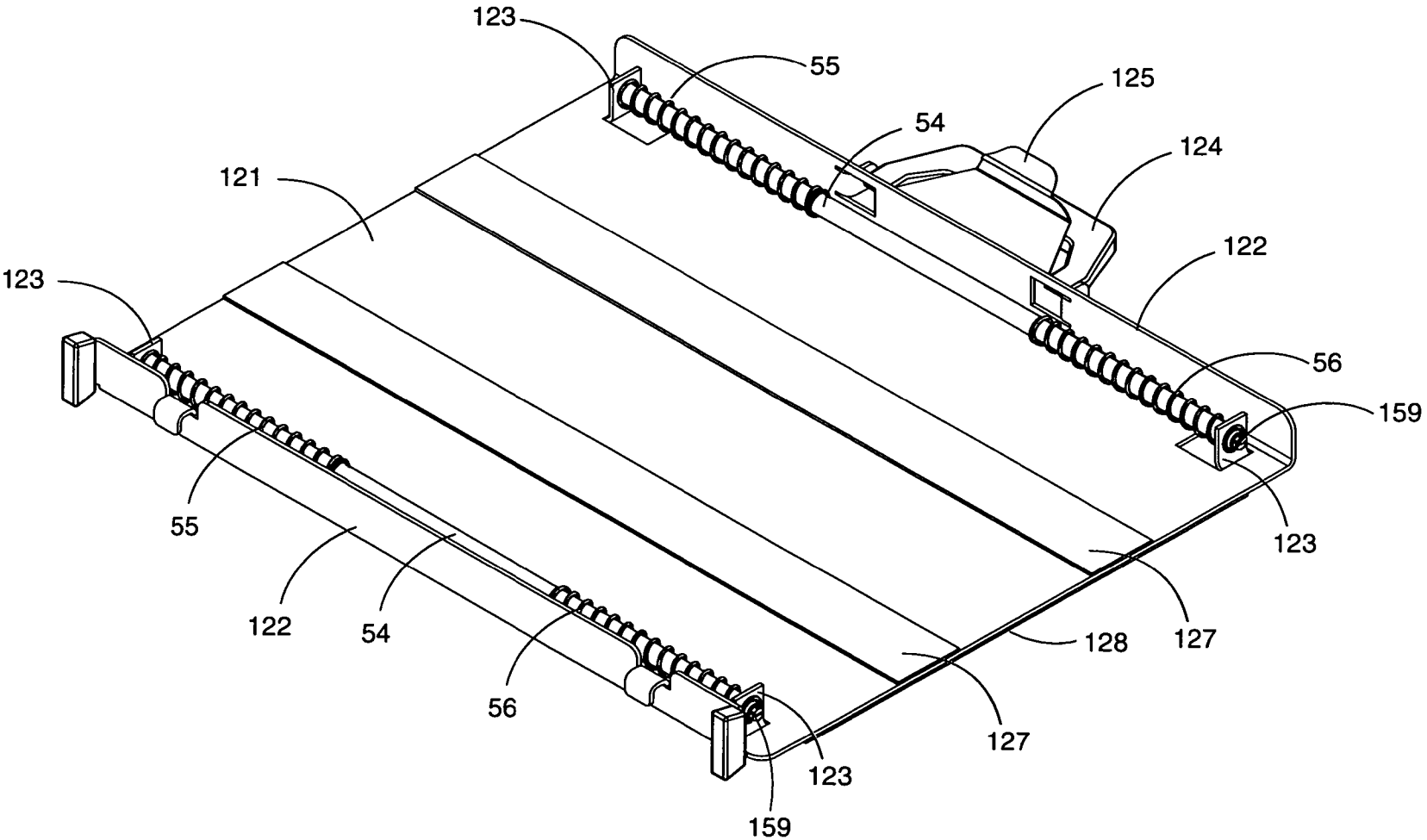
FIG. 13 is a perspective view of the base member and the carriage retraction assemblies of the portable golf practice device shown in FIG. 10 with the carriage tray omitted from the illustration to show the carriage retraction assemblies affixed to the base member.

To assemble, the sleeves 152 are fitted over the guide rails 54 and sandwiched between the forward and rearward compression springs 55, 56, and the guide rails 54 are fastened at the ends with fasteners, such as screws, 159 to support members 123 on the base member 120 such that movement of the carriage tray 151 is controlled by the carriage retraction assemblies 153. Placement of the one or more sleeves 152 and the length and restoring force specifications of the forward compression springs 55 and the rearward compression springs 56 are selected so that when in the rest, ready to use position or to store or transport, the carriage tray 151 will be positioned substantially even at each end, or centrally with respect to the base member 120. As illustrated in FIGS. 10, 12 and 13, the support members 123 to which the guide rails 54 are affixed are tabs that are punched and bent up from the bottom panel 121. However, other forms of supports such as mounting brackets that are commonly known may also be used. Likewise, screws are illustrated as the fasteners 159 used to attach the guide rails 54 with co-operative female threaded ends to the support members 123. It is to be understood that other fastening means that are commonly known and complement the specific type of supports chosen may be used. A base extension 130 is attached to the base member 120 with a hinge member 133 along one longitudinal side. The base extension 130, when open will be coplanar with the bottom panel 121, so that they will both rest on a surface. A handle 124 and a latch 125 are affixed to the side frame 122 opposite the base extension 130. The latch 125 is employed to secure the base extension 130 when the device is in a closed position (shown in FIG. 11). Both the handle 124 and the latch 125 are fitted to a hinge rod 126 and the hinge rod 126 is affixed to tabs formed in the side frame 122 of the base member 120. Other fastening means that are generally known may also be used to attach the handle 124 and the latch 125 to the base member 120. Preferably, a low-friction layer 127 consists of at least one strip made of a low-friction material is affixed to the top surface of the bottom panel 121 of the base member 120 facing the carriage tray 151, and friction pads 128, 134 are affixed to the bottom surface of the bottom panel 121 of the base member 120 and the bottom or outward surface of the base extension 130, respectively. The friction pads 128, 134 help reduce slippage and increase stability when the device 110 is in use.

In use, the portable golf practice device 10, 110 is disposed adjacent to a practice platform, which is generally any one of the commercially available golf practice mats used at golf practice facilities. The base extension 30, 130 is unfolded and slid under the practice platform. The golfer places a golf ball on the simulated turf surface 60 and takes a swing with a golf club. Referring to FIGS. 7-9 and 10, when the club head impacts the device, the force imparted to the carriage tray 51, 151 compacts the forward compression springs 55 and moves the carriage tray 51, 151, together with the simulated turf surface 60, forward as directed by the guide rails 54, (and down the slope with the version shown in FIGS. 1-9) thus simulating the feel to the golfer of striking a golf ball off natural turf and taking a divot. When the resistance from the forward compression springs 55 exceeds the forward force, the carriage tray 51, 151 and the simulated turf surface 60 are then returned to their original position. Rearward compression springs 56 are employed to absorb the retraction force and reduce shock to the aft end of the device. The sliding forward and descending down the slope of the carriage tray 51 and the simulated turf surface 60 also reduces club head bounce and lessens stress on the golfer's wrists and elbows, allowing the golfer to correctly practice his golf swing and decreasing risk of injury.

As mentioned above it is preferable that the extended dimension of the forward compression springs 55 be such as to bear on or be closely spaced from the sleeve or sleeves 152 so as to locate the carriage tray 151 in the desired ready to use or transport position, and it is also preferable that the rearward compression springs 56, similarly bear against or be closely spaced from the sleeve or sleeves 152.

All of the various layers comprising the portable golf practice device 10 are fabricated to have as low a profile or height as can be practically achieved while meeting all the strength requirements. The optimal height is generally equivalent to the average height of the commercially available golf practice mats used at golf practice facilities so the golfer can practice a standard golf swing with the golf ball being generally at the same level as his feet. If the height of the device deviated materially from that of the commercially available golf practice mats, a custom, complementary practice platform would then be required, thereby resulting in a device merely movable and not realistically portable.

Regarding the length and width dimensions of the portable golf practice device 10, they are to be short enough so the device is realistically portable and long enough to form a hitting area that can easily accommodate missed hits.

To conclude, with respect to the above description, it is to be understood that the optimal dimensional specifications for the parts of the invention, including variations in number, size, shape, form, placement, material and the method of fabrication and assembly, are deemed readily apparent to persons skilled in the art upon a reading of the foregoing description, and all equivalent specifications to those illustrated in the drawings and detailed in the description are intended to be encompassed by the present invention.

Further, it will be obvious to those skilled in the art that various modifications and revisions can be made to the embodiment shown herein without departing from the spirit and essential characteristics of the invention. It is therefore intended by the appended claims to cover any and all such modifications and revisions within the scope of the present invention.

The invention claimed is:

1. A golf practice device for simulating the response of natural turf when impacted by the head of a golf club during a golf swing, said device comprising;

a base member adapted to support a carriage retraction assembly on each of longitudinal sides;

a carriage tray positioned above said base member and having at least one sleeve on each of longitudinal sides to slidingly engage a carriage retraction assembly;

a simulated turf surface on said carriage tray;

a carriage retraction assembly supported on each of the longitudinal sides of said base member and being slidingly engaged with said at least one sleeve and having one or multiple forward compression springs extending forwardly of said at lease one sleeve on each longitudinal side for controlling sliding forward in the general direction of ball flight and retraction of said carriage tray and said simulated turf surface when said simulated surface is impacted by the head of a golf club striking a golf ball placed on said simulated turf surface.

2. The golf practice device of claim 1 wherein said carriage retraction assembly comprises;

a guide rail supported on said base member and said at least one sleeve on each of said longitudinal sides of said carriage tray is slidingly mounted on said respective guide rail on each of said longitudinal sides of said base member; and said one or multiple forward compression springs being fitted over said guide rail and said one or more forward compression springs being forward of said at least one sleeve such that forward movement and retraction of said carriage tray are controlled by said carriage retraction assembly.

3. The golf practice device of claim 2 wherein each of said carriage retraction assemblies further comprise one or multiple compression springs on said guide rail rearward of said at least one sleeve thereby to control the positioning of said carriage tray upon retraction to a ready to use position.

4. The golf practice device of claim 3 wherein each of said carriage retraction assemblies is carried in a rail housing on each side of said base member, said rail housing having a slot and said at least one sleeve extends from said carriage tray through said slot and onto said guide rail.

5. The golf practice device of claim 3 wherein said carriage retraction assembly on each side is carried on said base member by a forward support member and a rearward support member on which said guide rail is held at forward and rearward ends thereof respectively.

6. The golf practice device of claim 5 wherein said forward support member and said rearward support member are tabs bent up from said base member and having means to retain said forward and rearward ends of said guide rails.

7. The golf practice device of claim 5 further comprising at least one low friction strip on said base member, having a low friction surface facing said carriage tray.

8. The golf practice device of claim 5 wherein said at least one sleeve is a first sleeve and a second sleeve separated longitudinally and attached to said carriage tray and slidingly mounted on said guide rail.

9. The golf practice device of claim 3 wherein said at least one sleeve is a plurality of sleeves separated longitudinally and attached to said carriage tray and slidingly mounted on said guide rail.

10. The golf practice device of claim 9 further comprising a base extension hingedly attached to a longitudinal side of said base member and having a first, closed position covering said carriage tray and a second, open position coplanar with said base member, whereby in said first closed position the golf practice device is contained in a package defined by said base extension and said base member and in said second, open position said base extension can be used to stabilize said device and for installing under a mat.

11. The golf practice device of claim 10 further comprising a latch interengageable between said base extension and said base member to retain said base extension in said first, closed position.

12. The golf practice device of claim 10 wherein said base extension comprises one or multiple extension plates connected by hinge means such that said base extension can be unfolded and slid under a mat to stabilize said device in use and can be folded for transporting said device.

13. A golf practice device for simulating the response of natural turf when impacted by the head of a golf club during a golf swing, said device comprising:

a base member having a pair of spaced apart parallel housings extending along a length dimension;

a carriage tray having one or more sleeves affixed to both sides along the length dimension slidably positioned on said parallel housings of said base member;

a simulated turf surface fixed to said carriage tray; and carriage retraction means arranged on both sides of said carriage tray along the length dimension and fitted in said rail housings and having one or multiple forward compression springs extending forwardly of said at lease one sleeve on each longitudinal side for controlling the sliding forward in the general direction of the ball flight and the retraction of said carriage tray and said simulated turf surface when said simulated turf surface is impacted by the head of a golf club striking a golf ball placed on said simulated turf surface.

14. The golf practice device of claim 13 wherein each said carriage retraction means further comprises a guide rail, and said one or multiple forward compression springs and said sleeve being fitted over said guide rail with said one or more forward compression springs being forward of said sleeve such that forward movement and retraction of said carriage tray are controlled by said carriage retraction means.

15. The golf practice device of claim 14 wherein said carriage retraction means further comprises an energy absorbing element rearward of the carriage tray for limiting the retraction movement of the carriage tray.

16. The golf practice device of claim 15 wherein said energy absorbing element comprises one or multiple compression springs on each of said guide rails rearward of said sleeves.

17. The golf practice device of claim 13 further comprising a base extension connected to said base member.

18. The golf practice device of claim 17 wherein said base extension further comprises one or multiple extension plates connected by hinge means such that said base extension can be unfolded and slid under said platform to stabilize said device when in use and can be folded under said base member for transport or storage.

19. A golf practice device comprising;

a base member adapted to support a carriage assembly comprising support members on spaced apart longitudinal sides thereof, said support members having on each of said sides a forward support member and a rearward support member, said forward and rearward support members being longitudinally aligned;

a carriage assembly comprising a carriage tray and a carriage retraction assembly on each longitudinal side thereof;

said carriage tray being positioned above said base member;

at least one sleeve on each of longitudinal sides of said carriage tray;

a simulated turf surface on said carriage tray;

said carriage retraction assemblies comprising;

a guide rail on each side of said device extending longitudinally from and supported by said forward and rearward support members respectively, said at least one sleeve on each side being slidingly supported on the respective guide rail on each side;

one or multiple forward compression springs being fitted over each of said guide rails between said at least one sleeve and said forward support member on each side such that forward movement and retraction of said carriage tray are controlled by said carriage retraction assembly.

20. The golf practice device of claim 19 wherein said carriage retraction assembly further comprises one or multiple compression springs on said guide rail rearward of said at least one sleeve thereby to control the positioning of said carriage tray upon retraction to a ready to use position.

21. The golf practice device of claim 20 wherein said at least one sleeve is a plurality of sleeves separated longitudinally and attached to said carriage tray and slidingly mounted on said guide rail.

* * * * *